US006126480A

United States Patent [19]

Kawase et al.

[11] Patent Number: 6,126,480

[45] Date of Patent: Oct. 3, 2000

[54] CONNECTOR

[75] Inventors: Hajime Kawase; Satoru Nishide, both of Yokkaichi, Japan

[73] Assignee: Sumitomo Wiring Systems, Ltd., Japan

[21] Appl. No.: 09/106,753

[22] Filed: Jun. 30, 1998

[30] Foreign Application Priority Data

Jul. 1, 1997 [JP] Japan ..... 9-176109

[51] Int. Cl.[7] ..... H01R 3/00

[52] U.S. Cl. ..... 439/489; 439/352

[58] Field of Search ..... 439/489, 350, 439/352, 355, 357, 358, 527, 529, 353, 345, 488

[56] References Cited

U.S. PATENT DOCUMENTS

| | | | |
|---|---|---|---|
| 5,120,255 | 6/1992 | Kouda et al. | 439/489 |
| 5,348,493 | 9/1994 | Power | 439/352 |
| 5,370,543 | 12/1994 | Hamada et al. | 439/189 |
| 5,507,666 | 4/1996 | Yamanashi | 439/489 |
| 5,613,872 | 3/1997 | Fukuda et al. | 439/489 |

FOREIGN PATENT DOCUMENTS

| | | |
|---|---|---|
| 0 655 807 | 5/1995 | European Pat. Off. . |
| 0 732 775 | 9/1996 | European Pat. Off. . |
| 1-135674 | 9/1989 | Japan . |
| 2-20288 | 2/1990 | Japan . |
| 2-44269 | 3/1990 | Japan . |

*Primary Examiner*—Paula Bradley
*Assistant Examiner*—Alexander Gilman
*Attorney, Agent, or Firm*—Banner & Witcoff, Ltd.

[57] ABSTRACT

An electrical connector has a detecting member 17 is provided on the upper face of a locking member 9 so that it can slide freely in an anterior-posterior direction. A pair of arms 38 protrude in an anterior direction from two edges located in a width-wise direction of the lower face of the detecting member 17. A pair of plate-shaped ribs 41 which protrude upwards from the upper face of a corresponding male housing M correspond to the arms 38. If the detecting member 17 has been stopped in an advanced position before the housings M and F are fitted together, the anterior faces of the ribs 41 push against head members 39 of the arms 38 while the fitting operation is taking place and, as a result, the detecting member 17 is pushed back in a posterior direction. When the housings M and F are fitted further, the anterior end of the locking member 9 rises on top of the stopping member 15 and inclines. The detecting member 17 inclines together with it, and this causes the head members 39 of the arms 38 to rise onto the upper faces of the ribs 41. This allows the detecting member 17 to be reinserted. A half-fitted state of the connectors can thus be reliably detected.

14 Claims, 8 Drawing Sheets

CONNECTOR

TECHNICAL FIELD

The present invention relates to an electrical connector which detects a half-fitted condition.

BACKGROUND TO THE INVENTION

Conventionally, the change of position of a locking member of a connector assembly is used to detect whether a connector housing is in a half-fitted state. In one, a example connector housing is provided with a see-saw like locking member the anterior end of which is provided with a hook. From a corresponding connector housing projects a stopping member which engages the hook. When the housings are being fitted, the hook rises over the stopping member and the locking member is pushed in with its centre serving as a fulcrum. When the housings are in a correctly fitted state, the locking member reverts to its original position and the hook is engaged by the stopping member and is thereby latched. A detecting member is provided, which is inserted into the lower face of the posterior end of the locking member. If the housings are in a correct fitted state, the locking member returns to its original position and the lower face of the posterior end thereof is open, allowing the insertion of a detecting member. If the housings are stopped in a half-fitted state, the hook has risen onto the stopping member and the locking member has been moved into a position in which its posterior end is down. As a result, the detecting member strikes against the locking member and cannot be inserted, thereby allowing the detection of a half-fitted state.

However, the conventional example has the following problem. In the case where the locking member is of a seesaw type, when the hook on the anterior end has risen onto the stopping member, its other, posterior, end should be down. However, as the locking member is made from resilient plastics material, it is possible that, depending on various circumstances such as the shape of the locking member, only the anterior end bends when the hook has risen up, and the posterior end does not change shape and move down, or only changes shape very slightly. In this case, the detecting member can be inserted into the lower face of the posterior end of the locking member even though the housings remain in a half-fitted state, and the half-fitted state cannot be detected. Consequently, lack of reliability is a problem. The present invention has been developed after taking the above problem into consideration, and aims to present a detecting means which can detect a half-fitted state with a high degree of reliability.

SUMMARY OF THE INVENTION

According to the present invention there is provided a snap fit connector comprising two connector housings which fit together in a fitting direction, wherein one of the connector housings has a resilient latch member which, in use, engages a locking formation provided on the other of the housings to latch the housings in a fully fitted state, characterised in that said one of the housings is provided with a detecting member movable relative to the latch member between advanced and retracted positions, the detecting member co-operating with an abutment member provided on said one of the housings to impede advance movement of the detecting member when the housings are not in the fully fitted state, and thus indicate a half-fitted state between the connector housings, the connector further including pushing back means to move the detecting member from the advanced position to the retracted position when the connector housings are fitted together, said pushing back means being disengaged when the connector housings are in the fully fitted state and thereby allowing the detecting member to be moved from the retracted position to the advanced position.

The present invention thus provides a snap fit connector which seeks to eliminate the possibility of the detecting member moving to the advanced position, thereby indicating that the connector housings are in a fully fitted state, when the connector housings are in a half fitted state. The pushing back means ensure that the detecting member is urged towards the retracted position during fitting and until the connector housings are in fully fitted together. The connector housings can thus be fitted together without the need to check the position of the detecting member beforehand, and thus time is saved during fitting.

In a preferred embodiment the detecting member is disengaged from the pushing back means as a result of temporary inclination of the latch member when the connector housings are fitted together. The pushing back means may comprise a resilient arm provided on the detecting member which is aligned for contact with a protrusion provided on the other of the connector housings. Disengagement of the detecting member from the pushing back means preferably moves the arm out of alignment with the protrusion such that the arm overlies the protrusion. With the arm overlying the rib the detecting member can be moved from the retracted position to the advanced position. Preferably the detecting member includes a resilient latch to hold the detecting member in the advanced position when the connector housings are fully fitted together.

In a preferred embodiment the detecting member is carried by the latch member. Depending hooks on the detecting member engage lateral edges of the latch member such that the detecting member is slidable relative to the latch member in a plane parallel to the fitting direction.

BRIEF DESCRIPTION OF THE DRAWINGS

Other features of the invention will be apparent from the following description of a preferred embodiment shown by way of example only in the accompanying drawings in which:

FIG. 13 is a vertical cross-sectional view showing the detecting member beginning to be pushed in.

DESCRIPTION OF PREFERRED EMBODIMENTS

Figure 1:
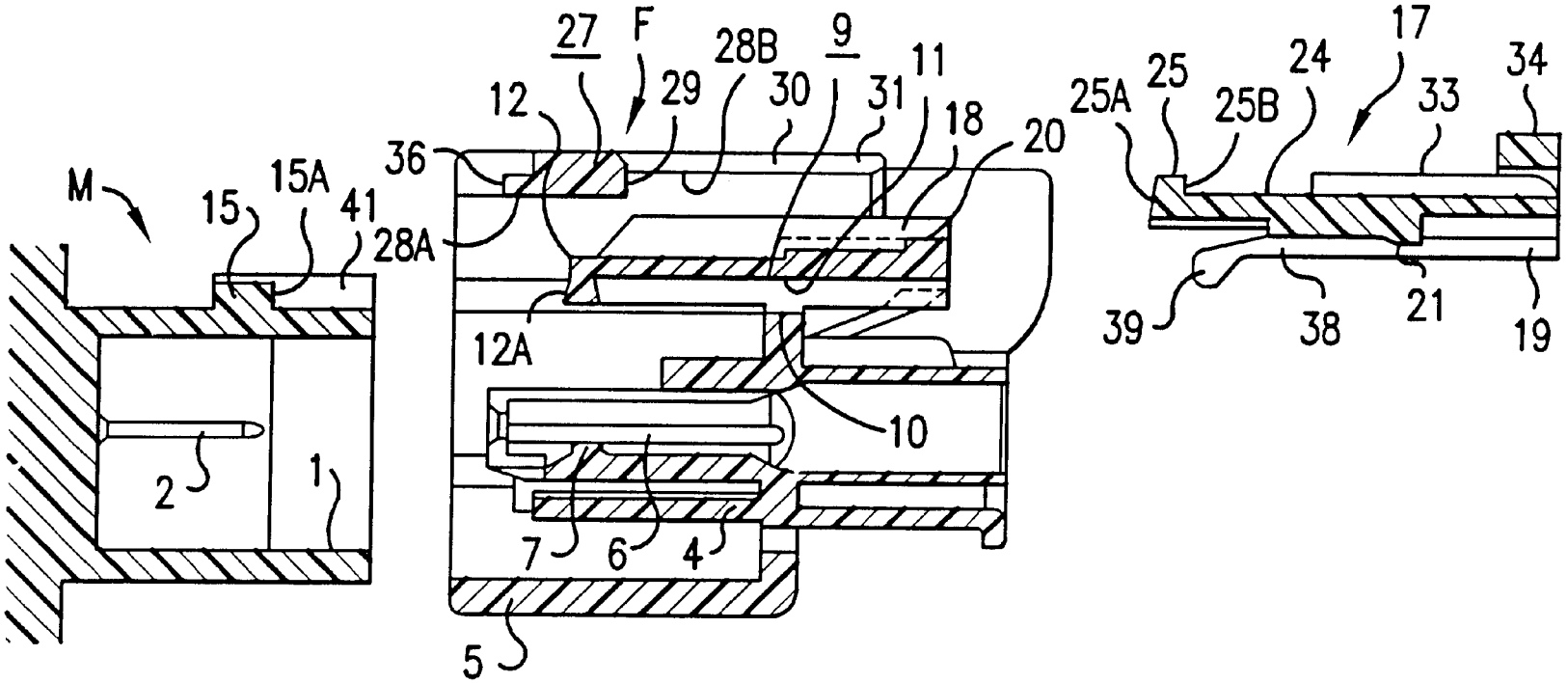
FIG. 1 is a disassembled vertical cross-sectional view of an embodiment of the present invention.

The present embodiment uses a waterproof, inertial lock type connector which, as shown in FIG. 1, is provided with a male connector housing M (hereafter referred to simply as the male housing) and a female connector housing F (hereafter referred to simply as the female housing) which can be mutually fitted together.

The male housing M is configured so that it protrudes directly from a plastics body of an engine component. It has a schematic angular tubular shape with a base, and its anterior face, which comprises its fitting face, is open. Its interior forms a fitting concave member 1, a plurality of male terminal fittings 2 (two terminal fittings in the present embodiment) protruding in an aligned manner from the interior face of the fitting concave member 1.

The female housing F is also made of plastics material, the periphery of an anterior end (the left side in FIG. 1) of a main body 4 being provided with a hood 5 having a schematically angular tubular shape. The male housing M fits into the inner edge of the hood 5, and the anterior end of the main body 4 protrudes into the fitting concave member 1. Inside the main body 4 are aligned a plurality of cavities 6 (two cavities) which correspond to the male terminal fittings 2 of the male housing. Female terminal fittings (not shown), to which terminals of an electric wire are attached, are inserted from the posterior face inside each cavity 6, and these female terminal fittings are stopped and then held in a stopping position by lances 7 provided within the cavities 6. A waterproof rubber stopper is attached to the posterior end of each female terminal fitting so that the entrance to each cavity 6 is sealed. Along with this the periphery of the main body 4 located on the inner side of the hood 5 is provided with a rubber ring (not shown). When the housings M and F are fitted, the rubber ring is clamped by the peripheral wall of the male housing M, and the housings M and F are sealed.

Figure 2:
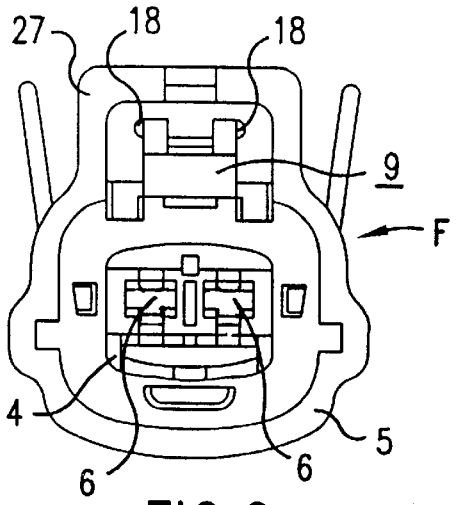
FIG. 2 is a front view of a female housing.
Figure 4:
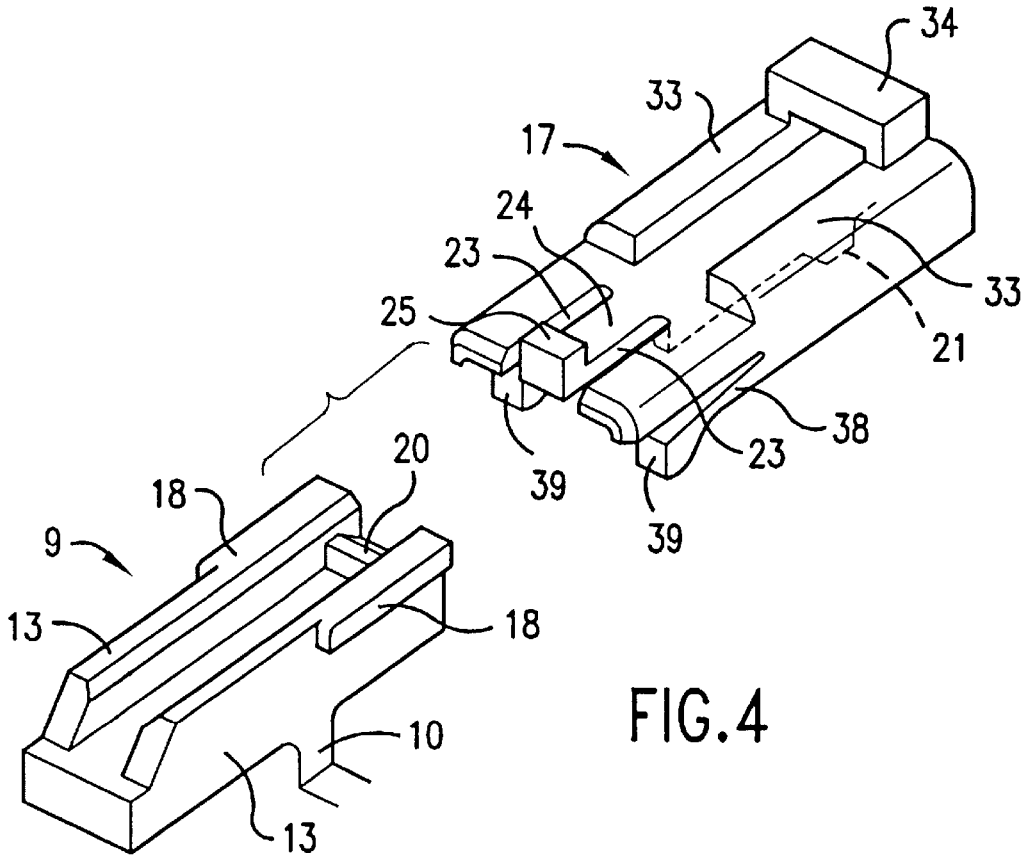
FIG. 4 is a diagonal view of a locking member and a detecting member.
Figure 5:
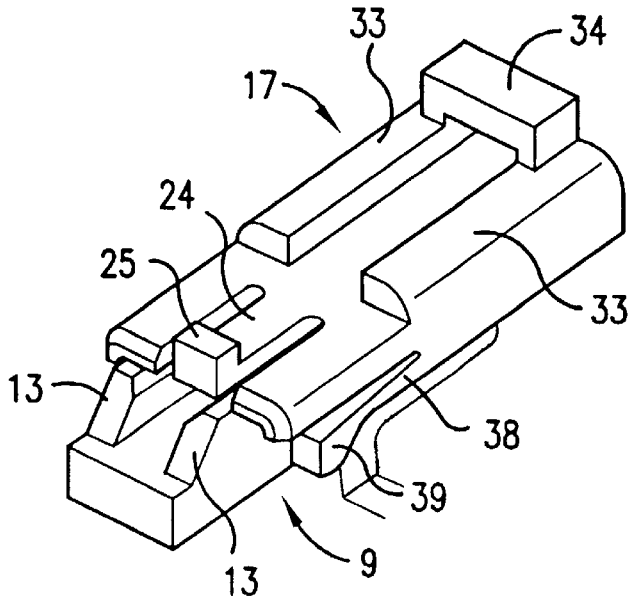
FIG. 5 is a diagonal view showing the detecting member attached to the locking member in a retracted position.

The housings M and F are provided with a locking mechanism which locks them in a correctly fitted position. For this purpose there is a locking member 9 provided on the central portion in a width-wise direction of the upper face of the female housing F. This locking member 9 is long and narrow in an anterior-posterior direction and, in the schematically central portion in its length-wise direction, left and right edges on its lower face connect it in a unified manner to the main body 4 via fulcrum members 10. The locking member 9 can be moved in a see-saw manner with the fulcrum members 10 serving as its centre. A groove 11, which starts slightly from behind the anterior end and is open at the posterior end, is formed in the lower face of the locking member 9. The anterior end portion of the groove 11 forms a hook member 12 which serves as a stopping member. As shown in FIG. 4, on the upper face of the locking member 9 there are left and right side walls 13 protruding upwards. As shown in FIG. 2, the central portion in a width-wise direction of the upper face of the hood 5 is cut away and the anterior end of the locking member 9 enters therein.

A stopping member 15 which stops the hook member 12 of the locking member 9 projects from the upper face of the male housing M. Corresponding contact faces 15A and 12A of the stopping member 15 and the hook member 12 respectively are almost vertical and comprise the inertial lock. That is, when the female housing F is pushed towards the male housing M, the hook member 12 of the locking member 9 strikes against the stopping member 15 and then meets a large resistance, causing the locking member 9 to move in a clockwise direction and rises on top of the stopping member 15 (see FIG. 12). After it has risen on top of the stopping member 15, inertial force pushes the female housing F into the correct fitting position. The hook member 12 crosses over the stopping member 15 to reach the correct fitting position, and the locking member 9 then reverts to its original shape. The hook member 12 is stopped by the posterior face of the stopping member 15 and is thereby locked (see FIG. 13). Further, this locking can be released by pressing on the posterior end of the locking member 9.

Since the corresponding contact faces 15A and 12A of the stopping member 15 and the hook member 12 are configured in the manner described above, it is difficult for the hook member 12 to rise over the stopping member 15, thereby requiring a high operating force. If the peak amount of energy required to cause the hook member 12 to rise on top of the stopping member 15 is designed to be greater than the peak frictional energy which occurs when the male and female terminal fittings are fitted, once the hook member 12 of the locking member 9 rises on to the stopping member 15 when the female housing F is pushed, inertial force will push the female housing into the correct fitting position, resulting in the male and female terminal fittings being correctly fitted and the male and female housings M and F being latched together. This comprises the so-called inertial lock.

Figure 16:
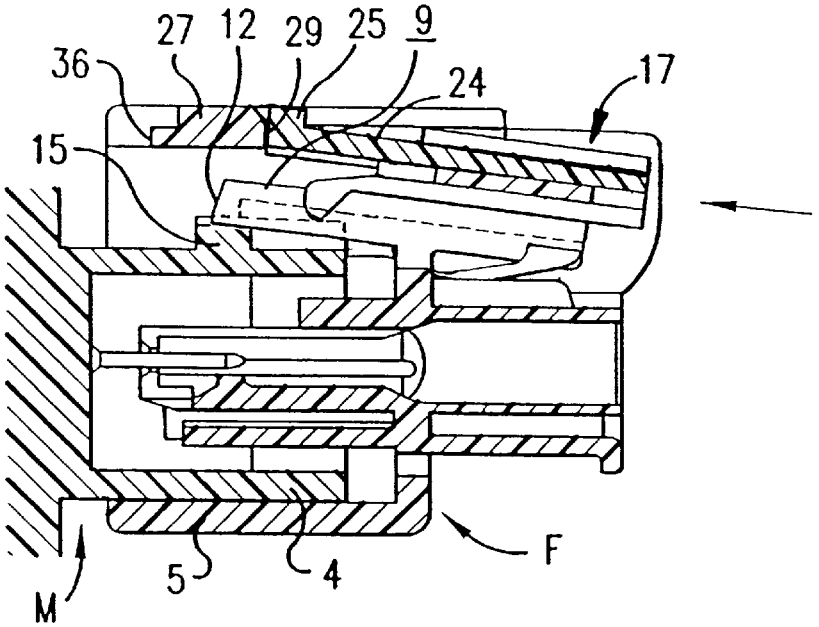
FIG. 16 is a vertical cross-sectional view in which a half-fitted state has been detected.

In the case where the inertial lock has been employed it is unlikely that the male and female housings M and F will remain in a half-fitted state. However, for example, in the case where the locking member 9 is kept pressed in a releasing direction while the female housing F is being pressed inwards, the inertial lock will not function and, as shown in FIG. 16, it is possible that the hook member 12 of the locking member 9 remains on top of the stopping member 15 and a half-fitted state occurs.

In order to detect such a half-fitted state, the locking member 9 of the female housing F is provided with a detecting member 17 made from plastics material and formed as a separate piece.

Figure 6:
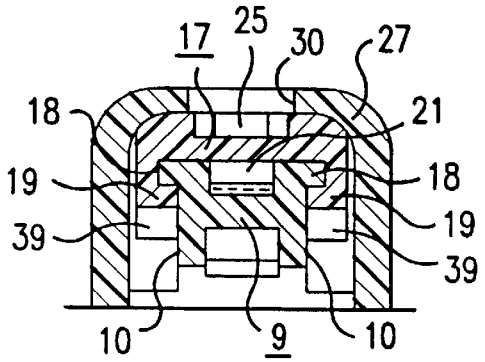
FIG. 6 is a horizontal cross-sectional view of the above.

This detecting member 17 has a length approximately comparable with that of the locking member 9. As shown in FIG. 6, it straddles the upper face of the locking member 9 and is attached so that it can be slid in a length-wise direction along the locking member 9. Specifically, guides 18 protrude along the posterior end of the upper edges of the external faces of the left and right side walls 13 of the locking member 9. The left and right side edges of the lower face of the detecting member 17 have foot members 19 into which the guides 18 are inserted. The detecting member 17 is pushed from behind while the guides 18 are inserted into the foot members 19. Further, as shown in FIG. 1, a stopping protrusion 20 protrudes from the upper face of the posterior end of the locking member 9. A protrusion 21 located on the lower face of the detecting member 17 is pushed over the stoping protrusion 20, is stopped by the stopping protrusion 20 and thus prevents the removal in the posterior direction of the detecting member 17.

As shown in FIG. 4, two slits 23 are located at the central portion in a width-wise direction of the anterior end of the detecting member 17. Between the slits 23 there is a detecting protrusion 24 which is bendable and which protrudes in an anterior direction. On the anterior edge of the upper face of the detecting protrusion 24 is a protruding member 25 which faces upwards. As shown in FIG. 1, on this protruding member 25 there are two anterior and posterior tapering faces 25A and 25B which taper off towards their upper ends.

As shown in FIG. 2, the cut-away portion on the upper face of the hood 5 has an arch-shaped arch member 27 which covers the upper face and sides of the locking member 9. A specified portion of the lower face at the posterior end of the arch member 27 is reduced to a thin wall. As a result the ceiling portion of the arch member 27 has a stepped shape in which the ceiling face of the posterior end is higher than that of the anterior end. When the detecting member 17 is attached to the locking member 9 with the locking member 9 in a natural position, the upper face of the anterior end of the detecting member 17 can enter the area directly below a low ceiling face 28A located at the anterior end of the arch member 27. Further, the protruding member 25 on the anterior edge of the detecting protrusion 24 corresponds to a stepped member 29 of the ceiling face.

Figure 3:
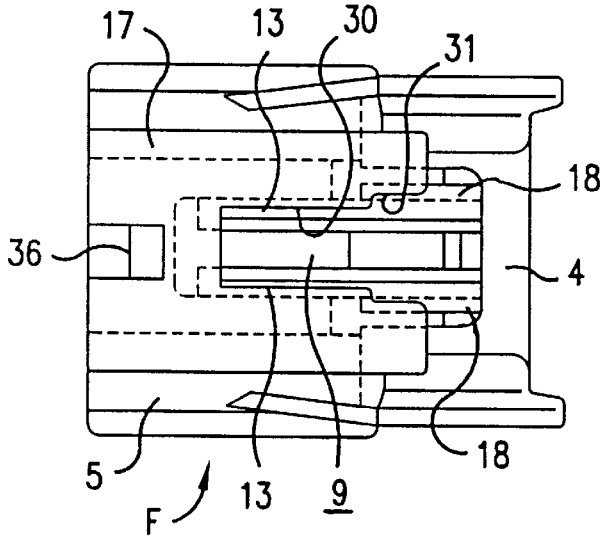
FIG. 3 is a plan view of a female housing.

Further, as shown in FIG. 3, there is an escape groove 30 located at the central portion in a width-wise direction of the thin wall of the posterior end of the ceiling member of the arch member 27. The escape groove 30 allows the detecting protrusion 24 of the detecting member 17 to bend in an upwards direction. The posterior end of the escape groove 30 is open, and this opening forms a width member 31.

On the upper face of the posterior end of the detecting member 17 there are two protruding column members 33 located along the left and right edges. These protruding column members 33 enter below a high ceiling face 28B of the arch member 27. The anterior edges of the protruding column members 33 protrude into the stepped member 29 of the ceiling face of the arch member 27 and, as a result, the detecting member 17 is stopped in an anterior direction. Moreover, there is an operating member 34 provided between the protruding column members 33 at the posterior ends of the upper faces thereof. When the protruding column members 33 protrude into the stepped member 29 and stop the detecting member 17 in an anterior direction, this operating member 34 fits with the width member 31 of the escape groove 30.

Further, there is a stopping groove 36 cut into the central portion in a width-wise direction of the anterior end of the ceiling member of the arch member 27. This stopping groove 36 stops the protruding member 25 on the anterior edge of the detecting protrusion 24 of the detecting member 17. This stopping groove 36 has an opening on the upper face which serves to release the engagement.

As described above, the detecting member 17 is pushed from behind towards the locking member 9 while the foot members 19 are inserted into the corresponding guides 18, and the protrusion 21 on the lower face of the detecting member 17 is pushed over the stopping protrusion 20 of the locking member 9. This stops the detecting member 17 in a posterior direction. Further, the detecting member 17 is stopped in an anterior direction when the protruding member 25 of the detecting protrusion 24 corresponds to the stepped member 29 of the arch member 27. The detecting member 17 is thus temporarily stopped in a retracting position (see FIG. 7). From this position, when the detecting member 17 is pushed further in an anterior direction, it is guided by the tapering face 25A on the anterior side of the protruding member 25 of the detecting protrusion 24, the detecting protrusion 24 changing shape and the detecting member 17 entering below the low ceiling face 28A of the arch member 27. Since the anterior edges of the protruding column members 33 protrude into the stepped member 29 of the arch member 27, the detecting member 17 is stopped in an anterior direction. In addition, the detecting protrusion 24 reverts to its original shape and the protruding member 25 fits with the stopping groove 36 and stops the detecting member 17 in a posterior direction. As a result, the detecting member 17 is fully stopped in the advanced position.

Further, a pair of bendable arms 38 extend in an anterior direction from the left and right side edges of the lower face at the anterior end of the detecting member 17. The anterior ends of the bendable arms 38 reach a position slightly below the anterior edge of the detecting member 17. On the anterior ends of the bendable arms 38 there are head members 39 which are bent diagonally downwards, the anterior faces of these head members 39 being vertical faces.

A pair of plate-shaped ribs 41 protrude to a specified height from both sides of the stopping member 15 on the upper face of the male housing M. These are separated by the same distance as that between the arms 38. When the locking member 9 is in a natural position, the head members 39 of the arms 38 make contact with the anterior faces of the ribs 41. If the locking member 9, together with the detecting member 17, is inclined, the head members 39 of the arms 38 rise above the upper faces of the ribs 41.

The above comprises the configuration of the present embodiment. Next, its operation is explained.

Figure 7:
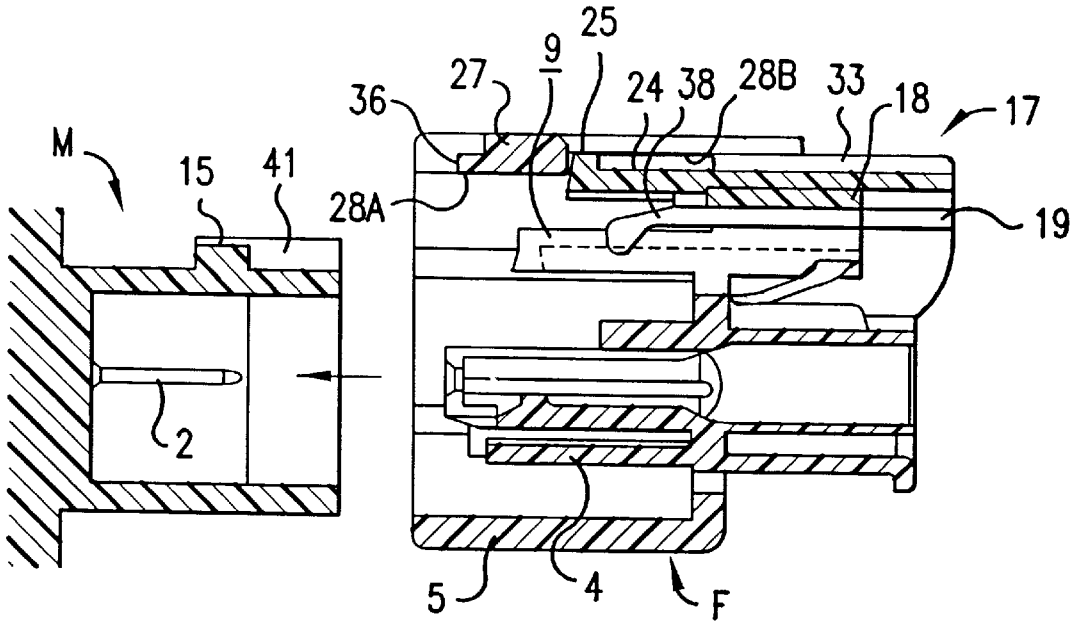
FIG. 7 is a vertical cross-sectional view of the housing in a state prior to fitting.

As shown in FIG. 7, a female terminal fitting is inserted into a female housing F and the detecting member 17 is attached to the locking member 9 in the retracted position in the manner described above. Then the attachment is carried out at the assembly site by pushing the female housing F onto the male housing M in the direction shown by the arrow in FIG. 7.

Figure 8:
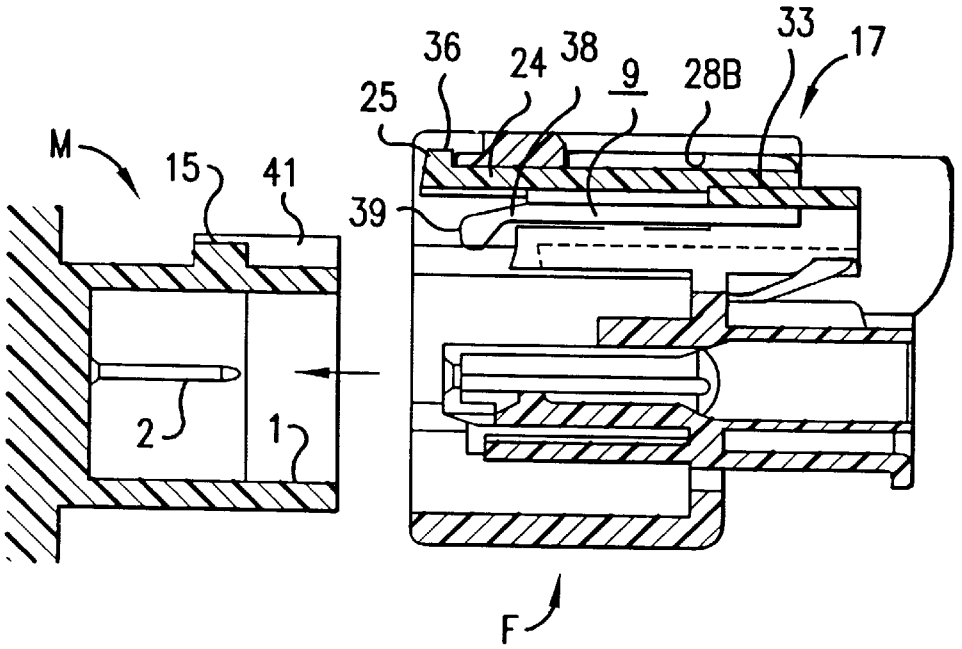
FIG. 8 is a vertical cross-sectional view showing the detecting member pushed into an advanced position prior to the housing being fitted.
Figure 9:
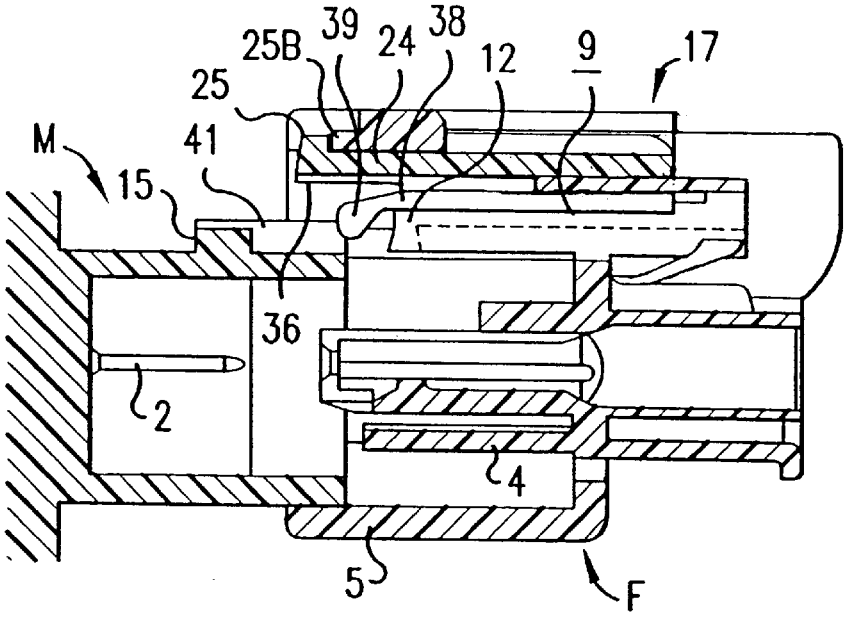
FIG. 9 is a vertical cross-sectional view showing the detecting member beginning to be pushed back.
Figure 11:
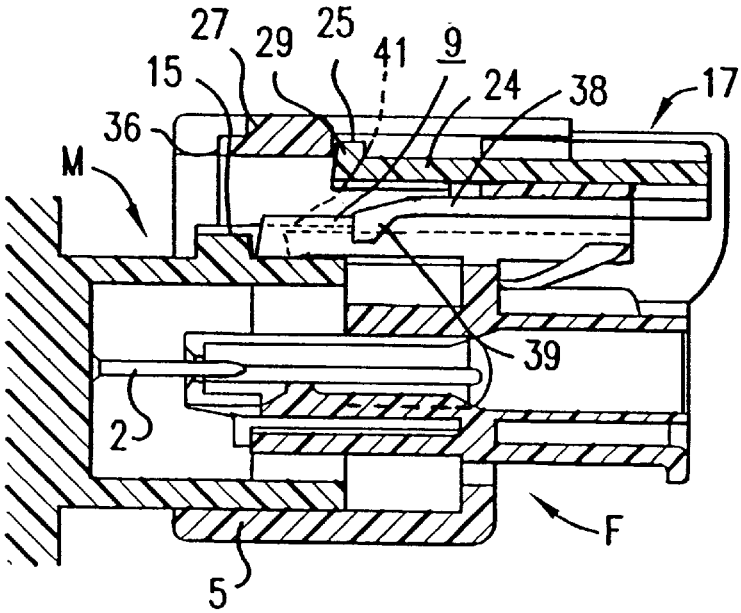
FIG. 11 is a vertical cross-sectional view in which the detecting member has been pushed back.
Figure 10:
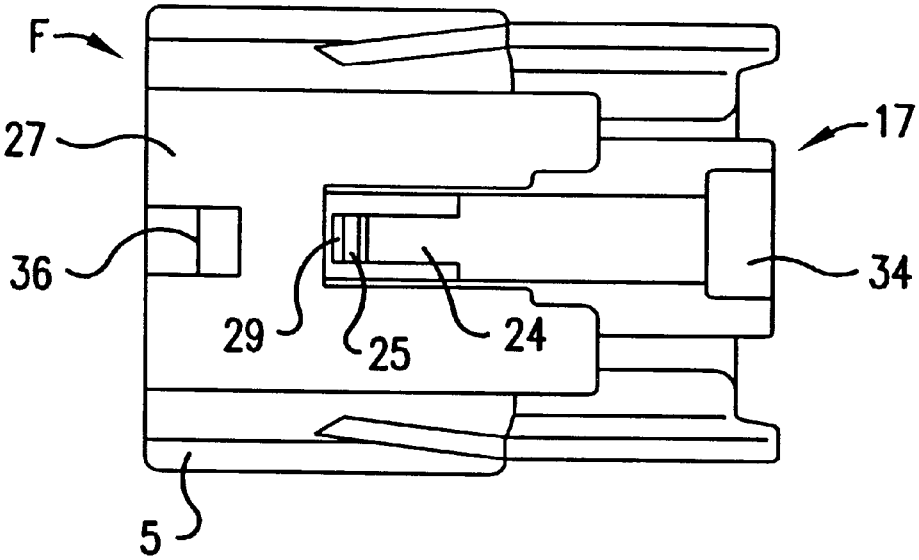
FIG. 10 is a plan view of the female housing in which the detecting member has been pushed back.

At this point, if the detecting member 17 is pushed in an anterior direction by an external force while the female housing F is being transported etc., the detecting member 17 can accidentally be retained in the advanced position, as shown in FIG. 8. In these circumstances, if the female housing F is pushed towards the male housing M, as shown by the arrow in FIG. 8, while this fitting is taking place the anterior faces of the ribs 41 of the male housing M push against the head members 39 of the arms 38 of the detecting member 17, as shown in FIG. 9. Thereupon, the detecting protrusion 24 is guided by the tapering face 25B, bends downwards and leaves the stopping groove 36, and the detecting member 17 is pushed back in a posterior direction along the locking member 9. As shown in FIGS. 10 and 11, if the fitting proceeds to the point where the anterior end of the locking member 9 makes contact with the stopping member 15 of the male housing M, the detecting member 17 almost returns to the retracted position and the protruding member 25 reaches the posterior side of the stepped member 29, the detecting protrusion 24 accordingly returning to its original shape.

Further, as shown in FIG. 7, when the detecting member 17 is in the correct retracted position, the detecting member 17 is not pushed back when the housings M and F are fitted together. This fitting process is shown in FIGS. 10 and 11.

Figure 12:
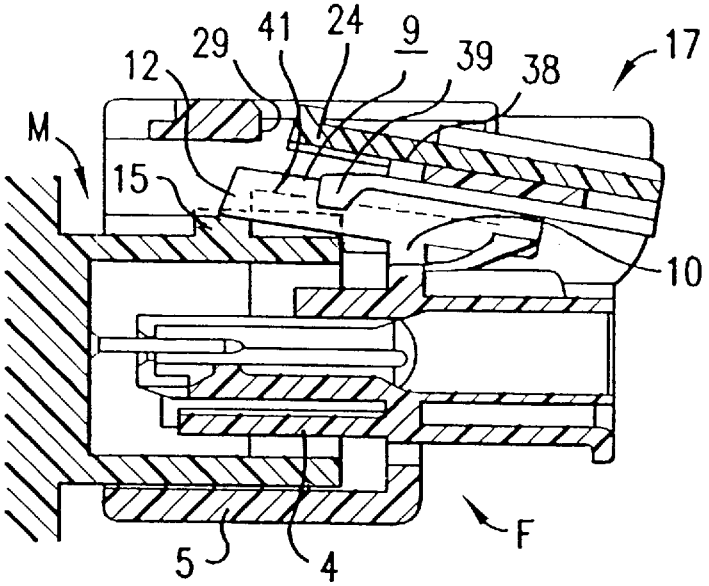
FIG. 12 is a vertical cross-sectional view of the two housings in the process of fitting in which the locking member is inclined.
Figure 13:
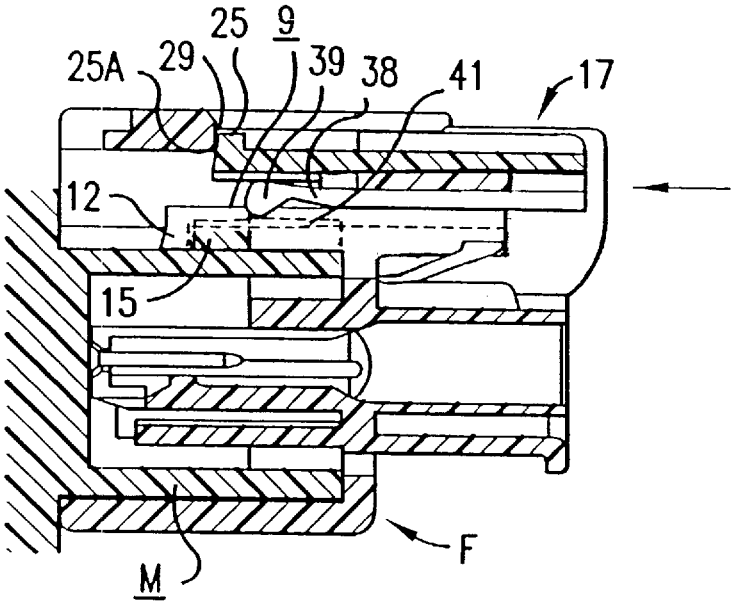

If the female housing F is pushed in from the position shown in FIGS. 10 and 11, the hook member 12 of the locking member 9 rises on top of the stopping member 15, as shown in FIG. 12. The locking member 9, with the fulcrum members 10 serving as its centre, moves in a clockwise direction, as shown in FIG. 12. The detecting member 17 inclines upwards together with the locking member 9, and as a result the head members 39 of the arms 38 move on to the upper face of the ribs 41. Next, when the female housing F is pushed into the correct position, the hook member 12 crosses over the stopping member 15, as shown in FIG. 13, and as a result the locking member 9 reverts to its original shape and the hook member 12 is engaged by the posterior face of the stopping member 15 and is thereby latched. At this point, the arms 38 of the detecting member 17 are bent upwards and are on the upper face of the ribs 41.

Figure 14:
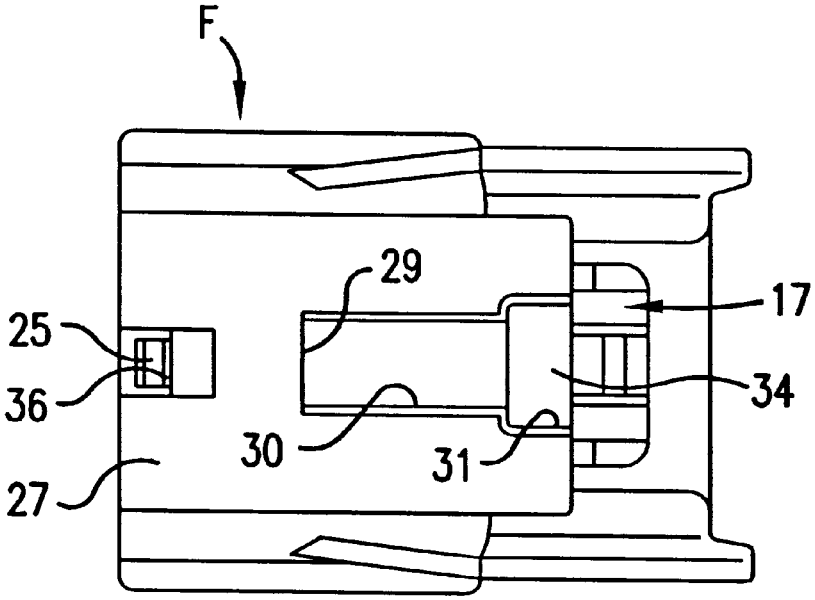
FIG. 14 is a plan view of the female housing in which the detecting member has been stopped in the advanced position.
Figure 15:
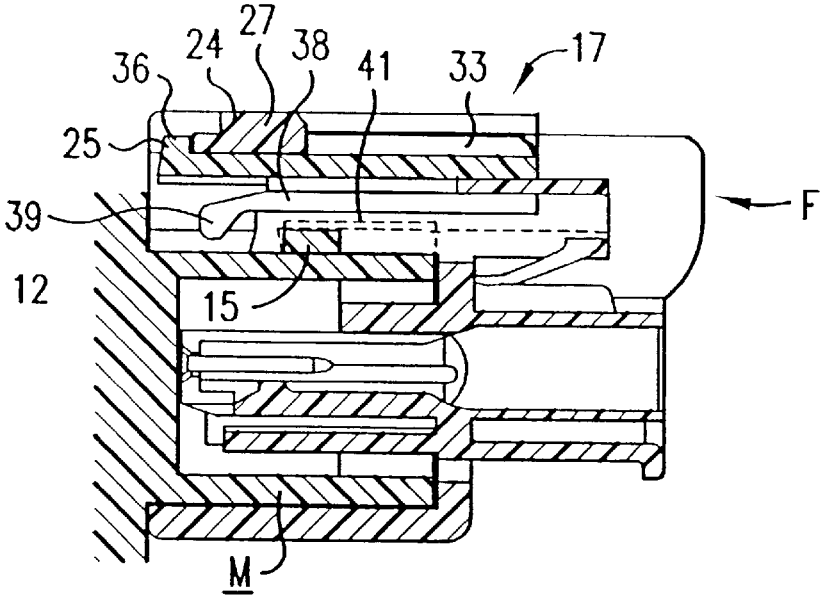
FIG. 15 is a vertical cross-sectional view of the two housings in a correct fitted state and in which the detecting member has been stopped in the advanced position.

Next, as shown by the arrow in FIG. 13, the detecting member 17 is pushed in an anterior direction, the tapering face 25A on the anterior side of the protruding member 25 of the detecting protrusion 24 making contact with the stepped member 29. Guided by this, the detecting protrusion 24 bends downwards and is pushed in. As shown in FIGS. 14 and 15, the anterior edges of the protruding column members 33 make contact with the stepped member 29 of the arch member 27 and the detecting protrusion 24 is stopped in an anterior direction. In addition, the detecting protrusion 24 reverts to its original shape and its protruding member 25 fits with the stopping groove 36 and stops the detecting member 17 in a posterior direction. As a result, the detecting member 17 is fully stopped in the advanced position. Further, the head members 39 of the arms 38 come off the ribs 41 towards the posterior sides of the ribs 41 and the arms 38 revert to their original shape.

As shown in FIG. 16, if the housings M and F are not correctly fitted together and remain in a half-fitted state, the hook member 12 of the locking member 9 remains on top of the stopping member 15 and remains bent in a clockwise direction. In this case, if the detecting member 17 is pushed in the direction of the arrow in FIG. 16, the detecting member 17 follows the direction of bending of the locking member 9 and is pushed in diagonally and upwards. The anterior end of the detecting member 17, including the detecting protrusion 24, hits against the stepped member 29 of the arch member 27 and as a result the pushing in operation is regulated. The half-fitted state is detected through this.

If the detecting member 17 is pushed in further, the arch member 27 is pushed by the detecting member 17, and the entire female housing F gets pushed in as a result. The female housing F is pushed into the correct position, the locking member 9 reverts to its original shape and the hook member 12 is stopped by the posterior face of the stopping member 15 and the housings M and F are latched. While the locking member 9 reverts to its original shape, the detecting member 17 also bends in the same direction and, as shown in FIG. 13, the tapering face 25A of the protruding member 25 of the detecting protrusion 24 reaches a state corresponding to the stepped member 29 of the arch member 27. Consequently, as the detecting member 17 is pushed in further, as described above, the detecting protrusion 24 bends downwards to allow its insertion in an anterior direction. As shown in FIGS. 14 and 15, the detecting member 17 is fully stopped in an anterior direction.

In the present embodiment, as described above, after the female housing F has been fitted to the male housing M, the detecting member 17 is pushed in. If there is a half-fitted state, the anterior end of the detecting member 17 hits against the stepped member 29 of the arch member 27 and the pushing in operation is stopped, the half-fitted state being thereby detected. At this point, in the case when the locking member 9 remains on top of the stopping member 15, since the configuration is such that the anterior end of the locking member 9 changes position, the detecting member 17 which is pushed in along the locking member 9 hits against the arch member 27 located at the anterior end of the upper face of the locking member 9. As a result, a half-fitted state can be detected with a high degree of certainty. Moreover, after the half-fitted state has been detected by pushing in the detecting member 17 further, the female housing F gets pushed into the correct position and locked.

Further, before the housings M and F are fitted together, even if the detecting member 17 is stopped in the advanced position, in accompaniment with the fitting of the housings M and F, the ribs 41 push against the arms 38 and push the detecting member 17 back in a posterior direction. The locking member 9 is inclined and in conjunction with this the detecting member 17 assumes a state where it can be reinserted. The half-fitted state is detected by means of this reinsertion. That is, even if the detecting member 17 is stopped in the advanced position, the detecting member 17 does not have to be removed from the stopped position and then returned. Rather, it returns automatically in a posterior direction and, as the half-fitted state can be detected, operability is improved.

Moreover, it may be arranged so that the detecting member 17 is previously set in the advanced position and the fitting is invariably carried out by causing the detecting member 17 to be pushed back so that the detecting member 17, which is (so to speak) in a concealed state, reappears. In such a case, this reappearance of the detecting member 17 can be utilised as a half-fitted state detection operation in order to alert the operator that a half-fitted state exists.

The present invention is not limited to the embodiments described above with the aid of figures. For example, the possibilities described below also lie within the technical range of the present invention. In addition, the present invention may be embodied in various other ways without deviating from the scope thereof.

(1) The present invention is not limited to the inertial lock used as an example in the present embodiment. Any ordinary locking system is equally suitable.

(2) Further, the present invention is not limited to the see-saw type locking member. An arm-type locking member provided with bendable cantilevered beam-shaped arms is equally suitable.

What is claimed is:

1. A snap fit connector comprising two connector housings which fit together in a fitting direction, wherein one of the connector housings has a resilient latch member which, in use, engages a locking formation provided on the other of the housings to latch the housings when the housings are in a fully fitted state, wherein said one of the housings is provided with a detecting member movable relative to the latch member between advanced and retracted positions, the latch member and detecting member being upwardly movable together to an inclined position with respect to said one of the housings during fitting together of the housings, the detecting member co-operating with an abutment member provided on said one of the housings to impede movement of the detecting member to the advanced position when the detecting member is in the inclined position and the housings are not in the fully fitted state, the detecting member indicating a half-fitted state between the connector housings when the detecting member is not in the advanced position, the connector further including pushing back means to engage and move the detecting member from the advanced position to the retracted position during fitting together of the connector housings before the latching member and detecting member are moved upwardly to the inclined position, thereby preventing the detecting member from remaining in the advanced position prematurely during the fitting together of the housings, said pushing back means being disengaged from the detecting member when the connector housings are in the fully fitted state and thereby allowing the detecting member to be moved from the retracted position to the advanced position to indicate a fully fitted state.

2. A snap fit connector according to claim 1 wherein the pushing back means disengages from the detecting member as a result of temporary inclination of the latch member and detecting member during fitting together of the connector housings.

3. A snap fit connector according to claim 1 wherein the detecting member is latchable in the advanced position by a form locking structure provided on the latch member and detecting member.

4. A snap fit connector according to claim 1 wherein the latch member is connected to said one of the connector housings by an upstanding resilient limb.

5. A snap fit connector according to claim 1 wherein the detecting member is carried on the latch member and is slidable along the latch member in the fitting direction.

6. A snap fit connector according to claim 5, further comprising hooks on the underside of the detecting member, said hooks cooperating with lateral edges of the latch member to retain the detecting member on the latch member.

7. A snap fit connector according to claim 1 wherein the pushing back means comprises a resilient arm on the detecting member and a co-operating protrusion on said other of the connector housings.

8. A snap fit connector according to claim 7 wherein the detecting member and said one of the connector housings are provided with a form locking structure to restrain the detecting member in the advanced position.

9. A snap fit connector according to claim 8 wherein the form locking structure includes a resilient latch on the detecting member which projects ahead of the resilient arm in the fitting direction.

10. A snap fit connector according to claim 7 wherein, after disengagement of the pushing back means from the detecting member, said resilient arm overlies the protrusion.

11. A snap fit connector according to claim 4 wherein the detecting member and said one of the connector housings are provided with a form locking structure to restrain the detecting member in the advanced position.

12. A snap fit connector according to claim 11, further comprising another resilient arm on the detecting member, the resilient arms being positioned on opposed sides of the resilient latch.

13. A snap fit connector according to claim 11 wherein the form locking structure includes a resilient latch on the detecting member which projects ahead of the resilient arm in the fitting direction.

14. A snap fit connector according to claim 13, further comprising another resilient arm on the detecting member, the resilient arms being positioned on opposed sides of the resilient latch.

* * * * *